US007251835B2

(12) United States Patent
Learmont

(10) Patent No.: US 7,251,835 B2
(45) Date of Patent: Aug. 7, 2007

(54) SOFT ARMOR

(75) Inventor: Henry Saxon Learmont, Newport Beach, CA (US)

(73) Assignee: Ultra Shield, Inc., Newport Beach, CA (US)

( * ) Notice: Subject to any disclaimer, the term of this patent is extended or adjusted under 35 U.S.C. 154(b) by 0 days.

(21) Appl. No.: 10/987,310

(22) Filed: Nov. 12, 2004

(65) Prior Publication Data

US 2007/0079414 A1 Apr. 12, 2007

Related U.S. Application Data

(60) Provisional application No. 60/520,263, filed on Nov. 14, 2003.

(51) Int. Cl.
*F41H 1/02* (2006.01)
*F41H 1/04* (2006.01)
*F41H 1/00* (2006.01)

(52) U.S. Cl. ..... 2/2.5; 2/6.1; 89/36.01; 89/36.02; 89/36.05

(58) Field of Classification Search ..... 2/2.5, 2/6.1; 109/78; 428/911; 89/36.05, 36.02, 89/36.01

See application file for complete search history.

(56) References Cited

U.S. PATENT DOCUMENTS 5,343,796 A * 9/1994 Cordova et al. ..... 89/36.02
5,395,671 A * 3/1995 Coppage et al. ..... 428/102
5,935,678 A * 8/1999 Park ..... 428/105
6,035,438 A 3/2000 Neal et al.
6,103,641 A * 8/2000 Gehring, Jr. ..... 442/46
6,127,291 A * 10/2000 Coppage et al. ..... 442/135
6,151,710 A 11/2000 Bachner, Jr.
6,170,378 B1 1/2001 Neal et al.
6,195,798 B1 3/2001 Bachner, Jr.
6,526,862 B1 * 3/2003 Lyons ..... 89/36.05
6,627,562 B1 * 9/2003 Gehring, Jr. ..... 442/35
6,745,661 B1 6/2004 Neal et al.
6,786,126 B2 * 9/2004 Sargent ..... 89/36.02
6,846,545 B2 * 1/2005 Thomas ..... 428/85

FOREIGN PATENT DOCUMENTS

WO WO 99/61862 A2 12/1999
WO WO 02/059412 A2 8/2002
WO WO 02/103275 A2 12/2002

OTHER PUBLICATIONS

Wikipedia.org, Bulletproof vests, entire document.*
International Search Report mailed Nov. 2, 2005 in corresponding International Application No. PCT/US2004/038122.

* cited by examiner

*Primary Examiner*—Gary L. Welch
*Assistant Examiner*—Robert H Muromoto
(74) *Attorney, Agent, or Firm*—Knobbe, Martens, Olson & Bear LLP

(57) ABSTRACT

Soft armor is disclosed. The soft armor comprises an armor structure having a threat side and an inner side inward of the threat side. The armor structure is formed from soft armor material, and the armor structure is substantially imperforable by rifle fire.

10 Claims, 13 Drawing Sheets

SOFT ARMOR

RELATED APPLICATIONS

This application claims the benefit under 35 U.S.C. § 119(e) of U.S. Provisional Patent Application No. 60/520,263, filed Nov. 14, 2003, titled SOFT ARMOR. The entire contents of the above-noted provisional patent application are hereby incorporated by reference herein and made a part of this specification.

BACKGROUND OF THE INVENTION

1. Field of the Invention

Certain disclosed embodiments relate generally to armor for protection of personnel and/or vehicles, buildings, etc.

2. Description of the Related Art

Currently known armor includes "hard" and "soft" armor. Hard armor can be made very strong, but may be too rigid for some applications. Soft armor has some advantages, but is generally weaker than hard armor.

SUMMARY OF THE INVENTION

According to one embodiment, there is provided soft armor. The soft armor comprises an armor structure having a threat side and an inner side inward of the threat side. The armor structure is formed from soft armor material, and the armor structure is substantially imperforable by rifle fire.

According to another embodiment, there is provided soft armor. The soft armor comprises an armor structure having a threat side and an inner side inward of the threat side. The armor structure is formed from soft armor material, and the armor structure is sufficiently strong to defeat rifle fire.

According to another embodiment, there is provided soft armor. The soft armor comprises an armor structure having a threat side and an inner side inward of the threat side. The armor structure is formed from soft armor material, and the armor structure provides at least NIJ type III ballistic protection.

According to another embodiment, there is provided a soft armor garment. The soft armor garment comprises a torso portion formed from soft armor material and configured to wrap around a torso of a wearer. The torso portion provides at least NIJ type III ballistic protection to at least a portion of the torso against threats from any side of the torso.

According to another embodiment, there is provided a soft armor garment. The soft armor garment comprises a torso portion formed from soft armor material and configured to wrap around a torso of a wearer. The torso portion provides at least NIJ type III ballistic protection to the torso against threats within a 360-degree threat envelope.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENT

Figure 1:
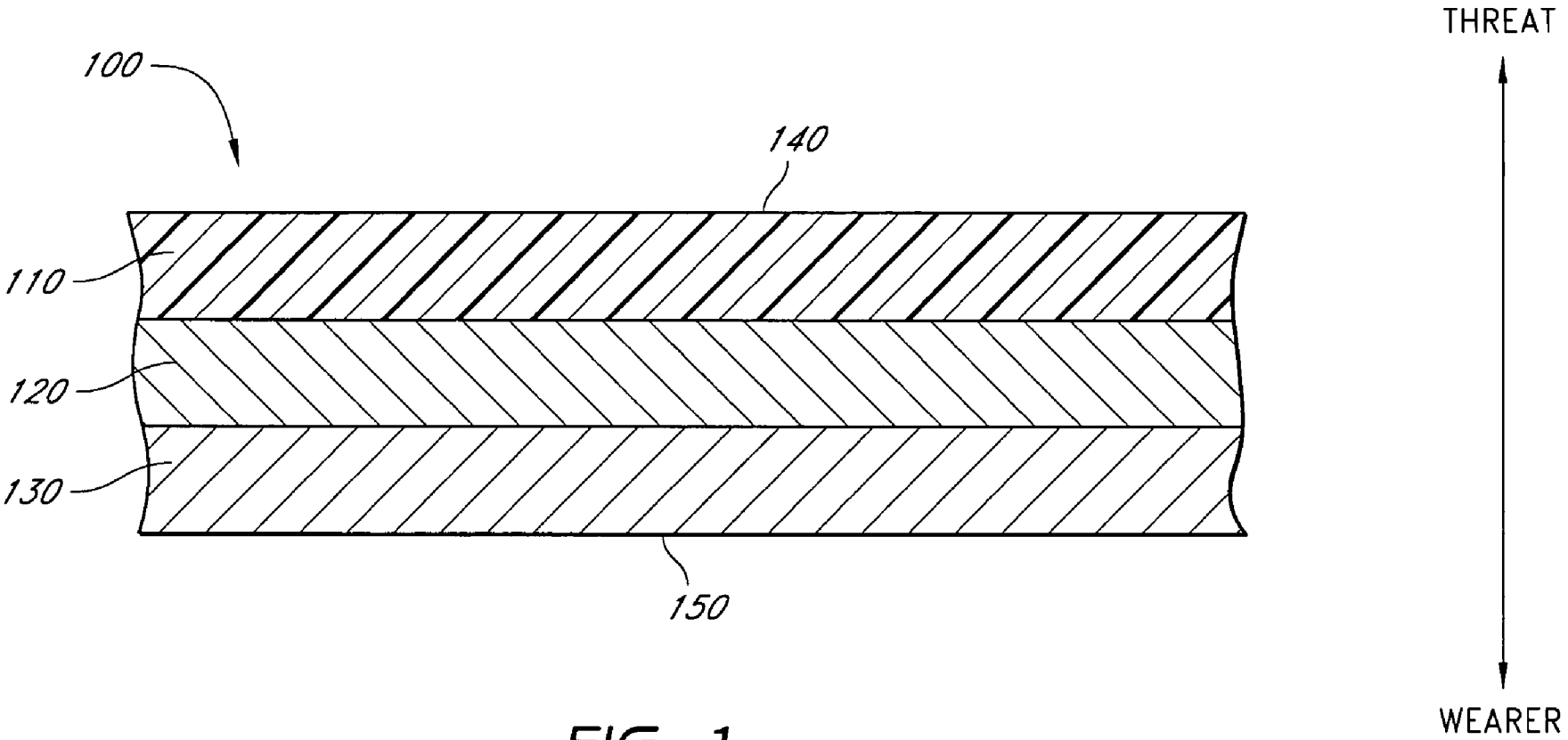
FIG. 1 is a schematic sectional view of one embodiment of an armor structure.

FIG. 1 depicts one embodiment of a soft armor structure 100 which generally comprises a layered construction of a first section 110, second section 120 and third section 130. The armor structure 100 is configured to be worn, mounted or otherwise employed such that the first section 110 is located closest to a threat (e.g., incoming gunfire) and the third section 130 is located closest to the wearer, vehicle, aircraft, building, etc. to be protected by the armor structure 100. Accordingly, the armor structure 100 includes a threat side 140 and an inner side 150.

In some embodiments, each of the first, second and third sections 110, 120, 130 is formed from soft armor material. In certain such embodiments, the first section 110 comprises ZYLON® (used herein to refer to PBO (poly(p-phenylene-2,6-benzobisoxazole)) material or fabric formed therefrom), the second section 120 comprises KEVLAR® (used herein to refer to para-aramid material or fabric formed therefrom), and the third section 130 comprises KEVLAR. In still other such embodiments, any one or more of the first, second and third sections 110, 120, 130 may comprise woven ZYLON or woven KEVLAR, or multiple layers of woven ZYLON or woven KEVLAR.

In one such embodiment, the first section 110 comprises 10 layers of ZYLON-530 (i.e., ZYLON similar to style no. 530 available from Hexcel Schwebel of Anderson, S.C.), the second section 120 comprises 6 layers of KEVLAR-704

(i.e., KEVLAR similar to style no. 704 available from Hexcel Schwebel), and the third section 130 comprises 8 layers of KEVLAR-726 (i.e., KEVLAR similar to style no. 726 available from Hexcel Schwebel). (In addition, if desired, the layers of the third section 130 may be laminated to improve resistance to backface deformation.) This embodiment of the armor structure 100 achieves type IIIa protection as established in the National Institute of Justice ("NIJ") standard no. 0101.04 (June 2001). In addition, this embodiment of the armor structure 100 protects against the following "supplemental" threats under test circumstances similar to those set forth in NIJ standard no. 0101.04: (1) a 60 grain, 9 mm RBCD armor-piercing bullet at 2105 feet per second (FPS); (2) a 52 grain, 9 mm MagSafe Agent Load bullet at 2120 FPS; (3) a 77 grain, 0.40 caliber MagSafe bullet at 1920 FPS; and (4) a 92 grain, 0.45 caliber MagSafe Agent Load bullet at 2020 FPS.

In further type IIIa-compliant embodiments of the armor structure 100, the first section 110 comprises 10 or more (e.g., 11, 12, 15, 20, 25 or more) layers of ZYLON-530, the second section 120 comprises 6 or more (e.g., 7, 8, 10, 12, 15, 20 or more) layers of KEVLAR-704, and the third section 130 comprises 8 or more (e.g., 9, 10, 12, 15, 20 or more) layers of KEVLAR-726. (In certain of these embodiments, one or more layers of soft armor material other than ZYLON-530, KEVLAR-704 and KEVLAR-726 may be employed in the first, second or third layers 110, 120, 130, respectively, in addition to the layers specified above.) All of these embodiments also protect against the "supplemental" threats enumerated above.

In still further type IIIa-compliant embodiments of the armor structure 100, an "overbuilt" section (i.e., more than 10 (e.g., 11, 12, 15, 20, 25 or more) layers of ZYLON-530 employed in the first section 110, more than 6 (e.g., 7, 8, 10, 12, 15, 20 or more) layers of KEVLAR-704 employed in the second section 120, or more than 8 (e.g., 9, 10, 12, 15, 20 or more) layers of KEVLAR-726 employed in the third section 130) is employed in one or two of the sections 110, 120, 130, and an "underbuilt" section (i.e., fewer than 10 layers of ZYLON-530 employed in the first section 110, fewer than 6 layers of KEVLAR-704 employed in the second section 120, or fewer than 8 layers or KEVLAR-726) is employed in the balance of the sections 110, 120, 130. In other type IIIa-compliant embodiments of the armor structure 100, such an "overbuilt" section is employed as one or two of the sections 110, 120, 130, and the balance of the sections 110, 120, 130 are omitted.

Figure 2:
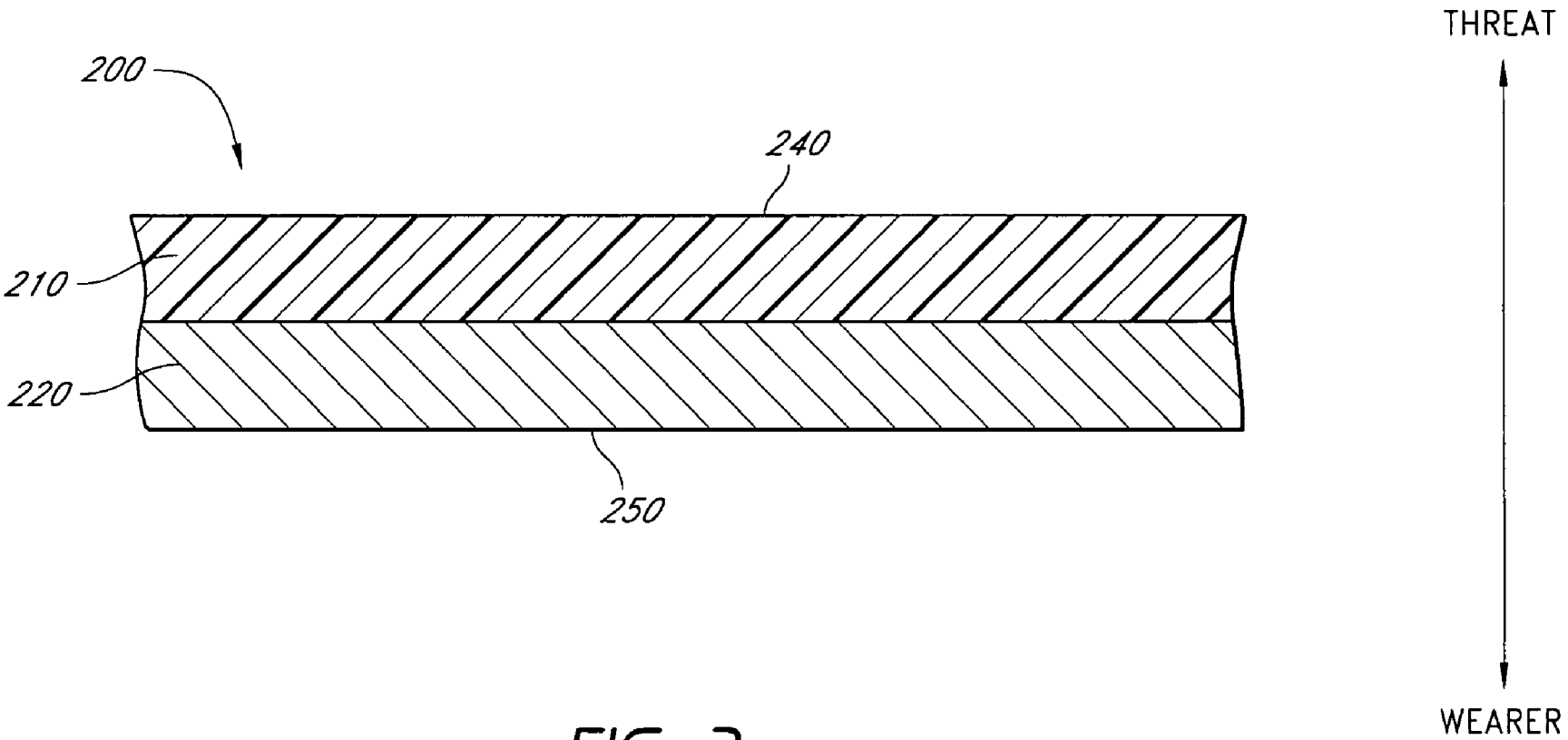
FIG. 2 is a schematic sectional view of another embodiment of an armor structure.

FIG. 2 depicts another embodiment of a soft armor structure 200 which generally comprises a layered construction of a first section 210 and a second section 220. The armor structure 200 is configured to be worn, mounted or otherwise employed such that the first section 210 is located closest to a threat (e.g., incoming gunfire) and the second section 220 is located closest to the wearer, vehicle, aircraft, building, etc. to be protected by the armor structure 200. Accordingly, the armor structure 200 includes a threat side 240 and an inner side 250.

In some embodiments, both of the first and second sections 210, 220, are formed from soft armor material. In certain such embodiments, the first section 210 comprises ZYLON and the second section 220 comprises KEVLAR. In still other such embodiments, one or both of the first and second sections 210, 220 may comprise woven ZYLON or woven KEVLAR, or multiple layers of woven ZYLON or woven KEVLAR.

In one such embodiment, the first section 210 comprises 22 layers of ZYLON-530 and the second section 220 comprises 3 layers of KEVLAR-726. (In addition, if desired, the layers of the second section 220 may be laminated to improve resistance to backface deformation.) This embodiment of the armor structure 200 achieves NIJ type IIIa protection. In addition, this embodiment of the armor structure 200 protects against the following "supplemental" threats under test circumstances similar to those set forth in NIJ standard no. 0101.04: (1) a 60 grain, 9 mm RBCD armor-piercing bullet at 2600 feet per second (FPS); (2) a 52 grain, 9 mm MagSafe Agent Load bullet at 2600 FPS; (3) a 77 grain, 0.40 caliber MagSafe bullet at 2400 FPS; and (4) a 92 grain, 0.45 caliber MagSafe Agent Load bullet at 2500 FPS.

In further type IIIa-compliant embodiments of the armor structure 200, the first section 210 comprises 22 or more (e.g., 23, 24, 25, 30, 35, 40, 50 or more) layers of ZYLON-530, and the second section 220 comprises 3 or more (e.g., 4, 5, 6, 9, 10, 12, 15 or more) layers of KEVLAR-726. (In these embodiments, one or more layers of soft armor material other than ZYLON-530 or KEVLAR-726 may be employed in the first or second layers 210, 220, respectively, in addition to the layers specified above.) All of these embodiments also protect against the "supplemental" threats enumerated above.

In still further type IIIa-compliant embodiments of the armor structure 200, an "overbuilt" section (i.e., more than 22 (e.g., 23, 24, 25, 30, 35, 40, 50 or more) layers of ZYLON-530 employed in the first section 210, or more than 3 (e.g., 4, 5, 6, 9, 10, 12, 15 or more) layers of KEVLAR-726 employed in the second section 220) is employed in one of the sections 210, 220, and an "underbuilt" section (i.e., fewer than 22 layers of ZYLON-530 employed in the first section 210, or fewer than 3 layers of KEVLAR-726 employed in the second section 220) is employed in the other of the sections 210, 220. In other type IIIa-compliant embodiments of the armor structure 200, such an "overbuilt" section is employed as one of the sections 210, 220, and the other of the sections 210, 220 is omitted.

Figure 3:
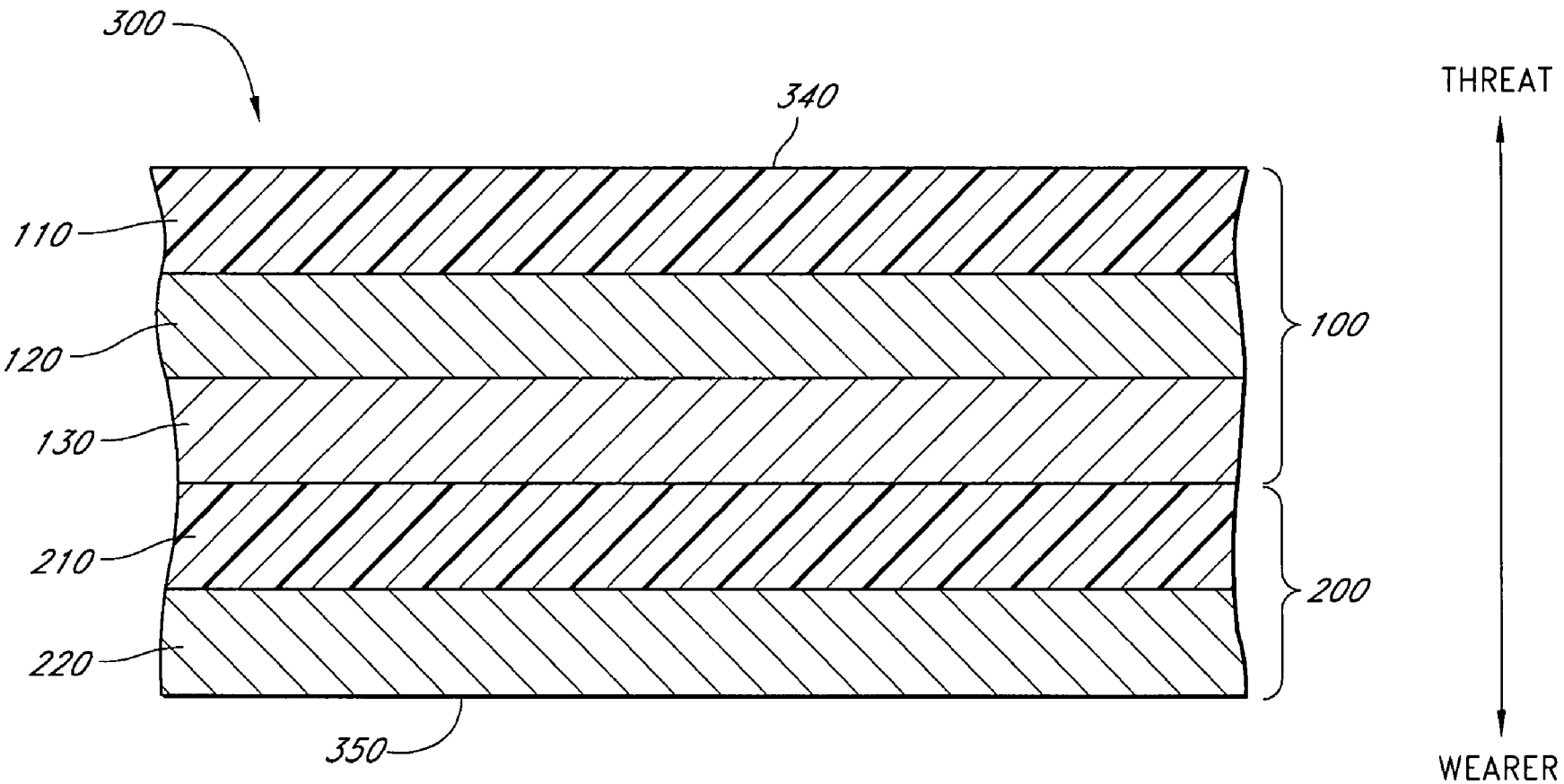
FIG. 3 is a schematic sectional view of another embodiment of an armor structure.

FIG. 3 depicts another embodiment of a soft armor structure 300 which generally comprises a first armor substructure comprising any of the embodiments disclosed herein of the armor structure 100, positioned adjacent a second armor substructure comprising any of the embodiments disclosed herein of the armor structure 200. The armor structure 300 is configured to be worn, mounted or otherwise employed such that the first section 110 of the armor structure 100 is located closest to a threat (e.g., incoming gunfire) and the second section 220 of the armor structure 200 is located closest to the wearer, vehicle, aircraft, building, etc. to be protected by the armor structure 300. Accordingly, the armor structure 300 includes a threat side 340 and an inner side 350. The various embodiments of the armor structure 300 defeat handgun fire and various "supplemental" threats as discussed above, and achieve NIJ type IIIa protection.

Figure 4:
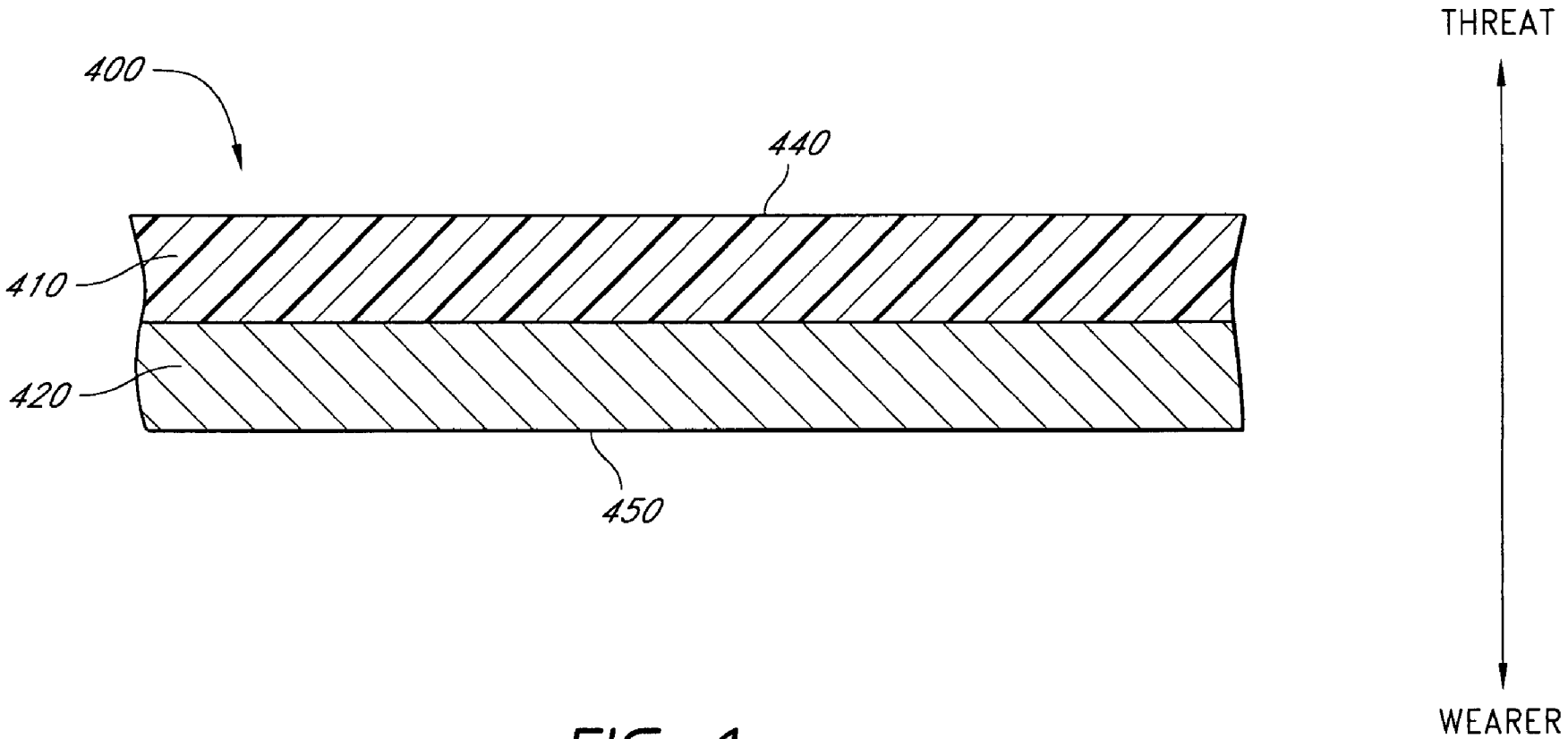
FIG. 4 is a schematic sectional view of another embodiment of an armor structure.

FIG. 4 depicts another embodiment of a soft armor structure 400 which generally comprises a layered construction of a first section 410 and a second section 420. The armor structure 400 is configured to be worn, mounted or otherwise employed such that the first section 410 is located closest to a threat (e.g., incoming gunfire) and the second section 420 is located closest to the wearer, vehicle, aircraft, building, etc. to be protected by the armor structure 400. Accordingly, the armor structure 400 includes a threat side 440 and an inner side 450.

In some embodiments, both of the first and second sections 410, 420, are formed from soft armor material. In certain such embodiments, the first section 410 comprises ZYLON and the second section 420 comprises KEVLAR. In still other such embodiments, one or both of the first and second sections 410, 420 may comprise woven ZYLON or woven KEVLAR, or multiple layers of woven ZYLON or woven KEVLAR.

In one such embodiment, the first section 410 comprises 90 layers of ZYLON-530 and the second section 420 comprises 26 layers of KEVLAR-726. (In addition, if desired, the layers of the second section 420 may be laminated to improve resistance to backface deformation.) This embodiment of the armor structure 400 defeats both handgun and rifle fire, and achieves NIJ type III protection.

In further type III-compliant embodiments of the armor structure 400, the first section 410 comprises 90 or more (e.g., 91, 92, 95, 100, 110, 125, 150 or more) layers of ZYLON-530, and the second section 220 comprises 26 or more (e.g., 27, 28, 30, 35, 40, 50 or more) layers of KEVLAR-726. (In these embodiments, one or more layers of soft armor material other than ZYLON-530 or KEVLAR-726 may be employed in the first or second layers 410, 420, respectively, in addition to the layers specified above.)

In still further type III-compliant embodiments of the armor structure 400, an "overbuilt" section (i.e., more than 90 (e.g., 91, 92, 95, 100, 110, 125, 150 or more) layers of ZYLON-530 employed in the first section 410, or more than 26 (e.g., 27, 28, 30, 35, 40, 50 or more) layers of KEVLAR-726 employed in the second section 420) is employed in one of the sections 410, 420, and an "underbuilt" section (i.e., fewer than 90 layers of ZYLON-530 employed in the first section 410, or fewer than 26 layers of KEVLAR-726 employed in the second section 420) is employed in the other of the sections 410, 420. In other type III-compliant embodiments of the armor structure 400, such an "overbuilt" section is employed as one of the sections 410, 420, and the other of the sections 410, 420 is omitted.

Figure 5:
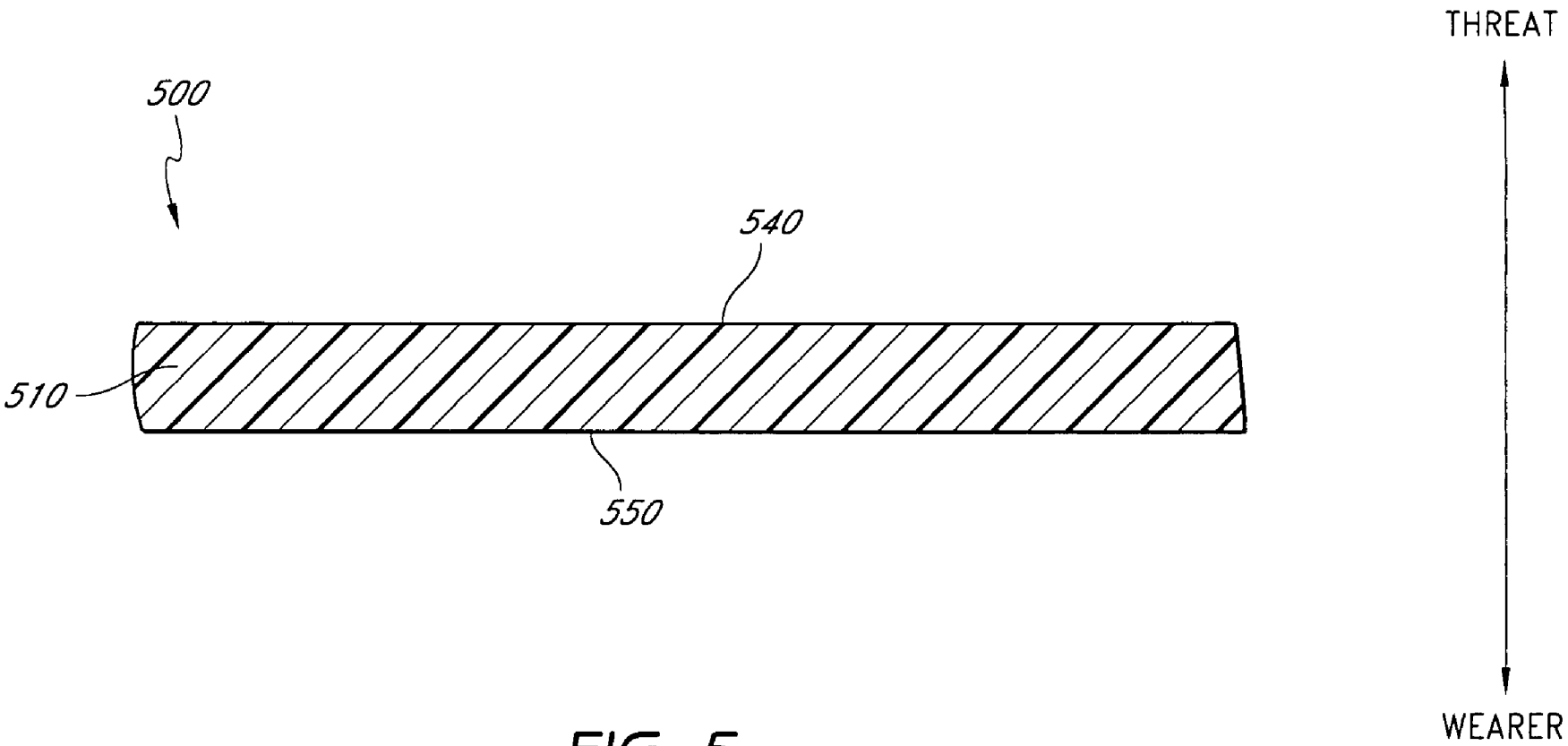
FIG. 5 is a schematic sectional view of another embodiment of an armor structure.

FIG. 5 depicts another embodiment of a soft armor structure 500 which generally comprises a single section 510 formed from soft armor material and having a threat side 540 and an inner side 550. The armor structure 500 is configured to be worn, mounted or otherwise employed to protect a human wearer, vehicle, aircraft, building, etc.

In some embodiments, the armor structure 500 is formed from ZYLON; in certain such embodiments, the armor structure 500 may be formed from woven ZYLON, or multiple layers of woven ZYLON. In still another such embodiment, armor structure 500 comprises 258 layers of ZYLON-530. This embodiment of the armor structure 500 defeats both handgun and rifle fire, and achieves NIJ type III protection.

In further type III-compliant embodiments of the armor structure 500, the structure 500 comprises 258 or more (e.g., 259, 260, 265, 275, 300, 350, 400 or more) layers of ZYLON-530. (In these embodiments, one or more layers of soft armor material other than ZYLON-530 may be employed in addition to the layers specified above.)

Figure 6:
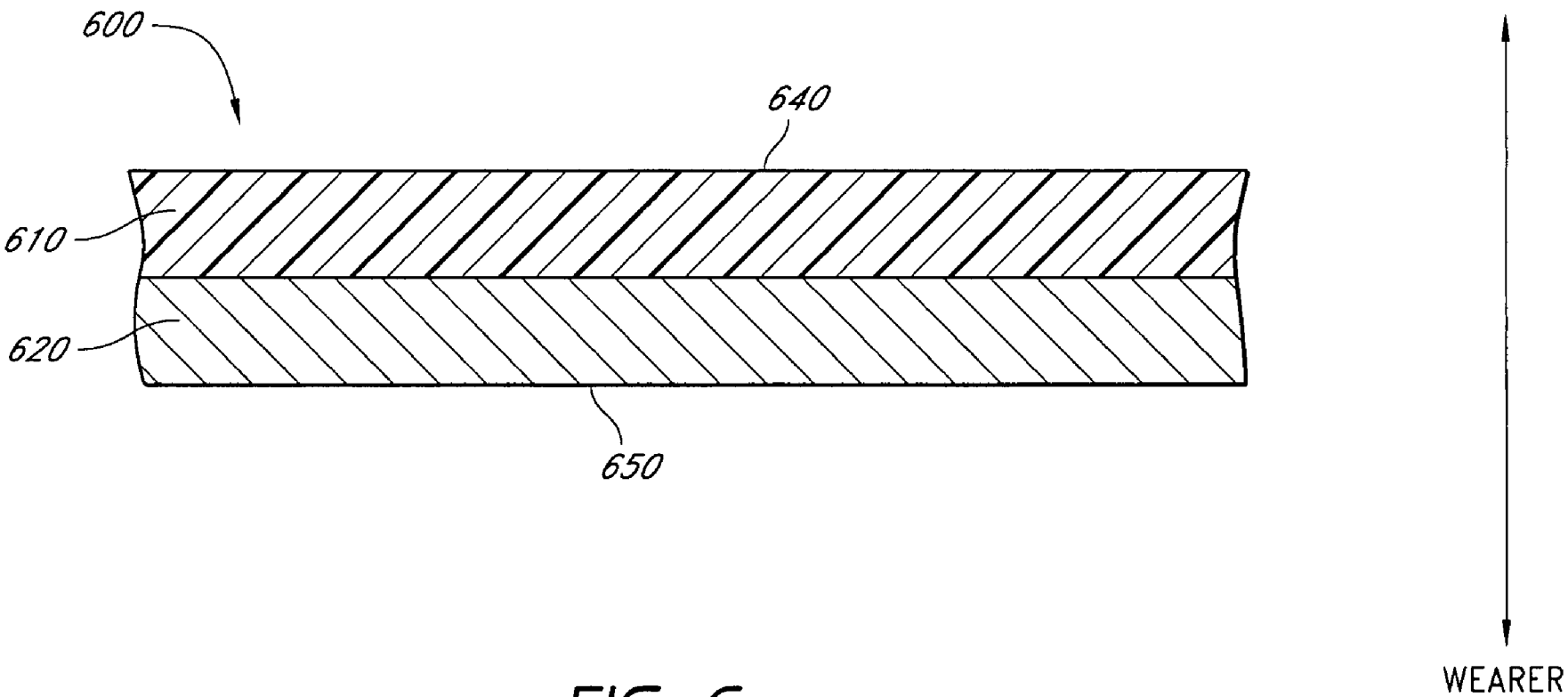
FIG. 6 is a schematic sectional view of another embodiment of an armor structure.

FIG. 6 depicts another embodiment of a soft armor structure 600 which generally comprises a layered construction of a first section 610 and a second section 620. The armor structure 600 is configured to be worn, mounted or otherwise employed such that the first section 610 is located closest to a threat (e.g., incoming gunfire) and the second section 620 is located closest to the wearer, vehicle, aircraft, building, etc. to be protected by the armor structure 600. Accordingly, the armor structure 600 includes a threat side 640 and an inner side 650.

In some embodiments, both of the first and second sections 610, 620, are formed from soft armor material. In certain such embodiments, the first section 610 comprises ZYLON and the second section 620 comprises SPECTRASHIELD PLUS® (used herein to refer to ultra-high molecular weight polyethylene or fabric formed therefrom). In still other such embodiments, one or both of the first and second sections 610, 620 may comprise woven ZYLON or woven SPECTRASHIELD PLUS, or multiple layers of woven ZYLON or woven SPECTRASHIELD PLUS.

In one such embodiment, the first section 610 comprises 100 layers of ZYLON-530 and the second section 620 comprises 135 layers of SPECTRASHIELD PLUS-902 (i.e., SPECTRASHIELD PLUS similar to style no. 902 available from Hexcel Schwebel of Anderson, S.C., or from Honeywell Corp. of Morristown, N.J.). This embodiment of the armor structure 600 defeats both handgun and rifle fire, and achieves NIJ type III protection.

In further type III-compliant embodiments of the armor structure 600, the first section 610 comprises 100 or more (e.g., 101, 102, 105, 110, 125, 150, 200 or more) layers of ZYLON-530, and the second section 220 comprises 135 or more (e.g., 136, 137, 140, 150, 175, 200 or more) layers of SPECTRASHIELD PLUS-902. (In these embodiments, one or more layers of soft armor material other than ZYLON-530 or SPECTRASHIELD PLUS-902 may be employed in the first or second layers 610, 620, respectively, in addition to the layers specified above.)

In still further type III-compliant embodiments of the armor structure 600, an "overbuilt" section (i.e., more than 100 (e.g., 101, 102, 105, 110, 125, 150, 200 or more) layers of ZYLON-530 employed in the first section 610, or more than 135 (e.g., 136, 137, 140, 150, 175, 200 or more) layers of SPECTRASHIELD PLUS-902 employed in the second section 620) is employed in one of the sections 610, 620, and an "underbuilt" section (i.e., fewer than 100 layers of ZYLON-530 employed in the first section 610, or fewer than 135 layers of KEVLAR-726 employed in the second section 620) is employed in the other of the sections 610, 620. In other type III-compliant embodiments of the armor structure 600, such an "overbuilt" section is employed as one of the sections 610, 620, and the other of the sections 610, 620 is omitted.

Figure 7:
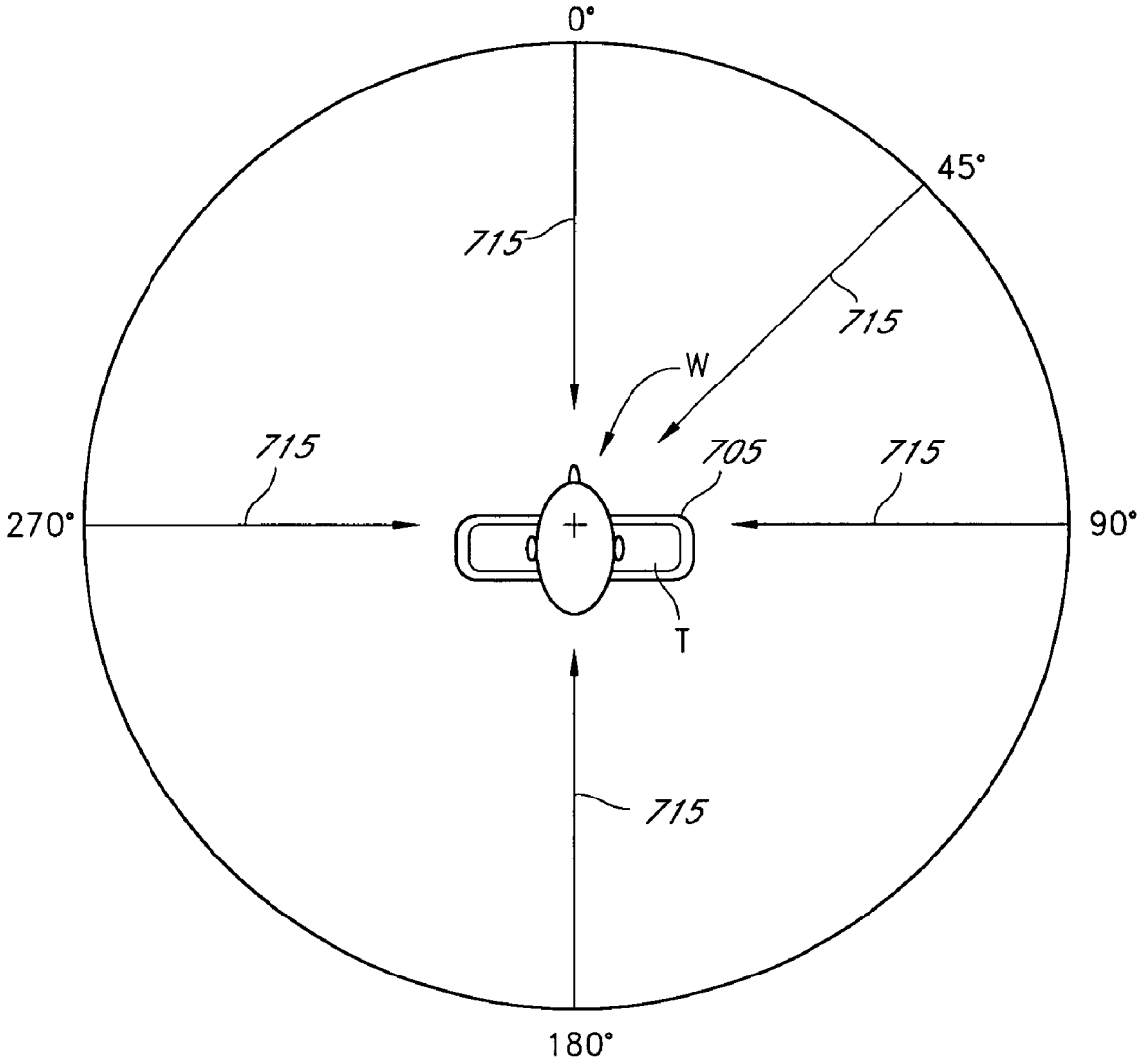
FIG. 7 is a schematic top view of an armored vest and a threat envelope defeated by the armored vest.

Any of the embodiments of the soft armor structures 100, 200, 300, 400, 500, 600 disclosed herein may be employed to construct any of a variety of armored equipment. For example, and of the disclosed armor structures may be employed to construct soft body armor, such as a bulletproof vest. In one embodiment shown in FIG. 7, such a vest 705 is entirely constructed from one or a combination of the armor structures disclosed herein, providing ballistic protection of a given type (e.g., type IIIa, type III, type 2.7A, rifle-fire-defeating) that "wraps" completely around a torso T of a wearer W. In other words, such a vest provides 360-degree protection for the torso T (at the ballistic protection level provided by the armor structure 100/200/300/400/500/600 chosen to construct the vest 705), by defeating threats 715 approaching the standing/kneeling/sitting wearer W from any angle as depicted in FIG. 7. (For example, "360-degree" level III protection may be facilitated by constructing the vest 705 from any suitable embodiment of the armor structures 300/400/500/600 disclosed above.) The vest 705 may also be configured to cover the tops of the wearer's shoulders, to protect the torso T from threats from above.

Figure 8:
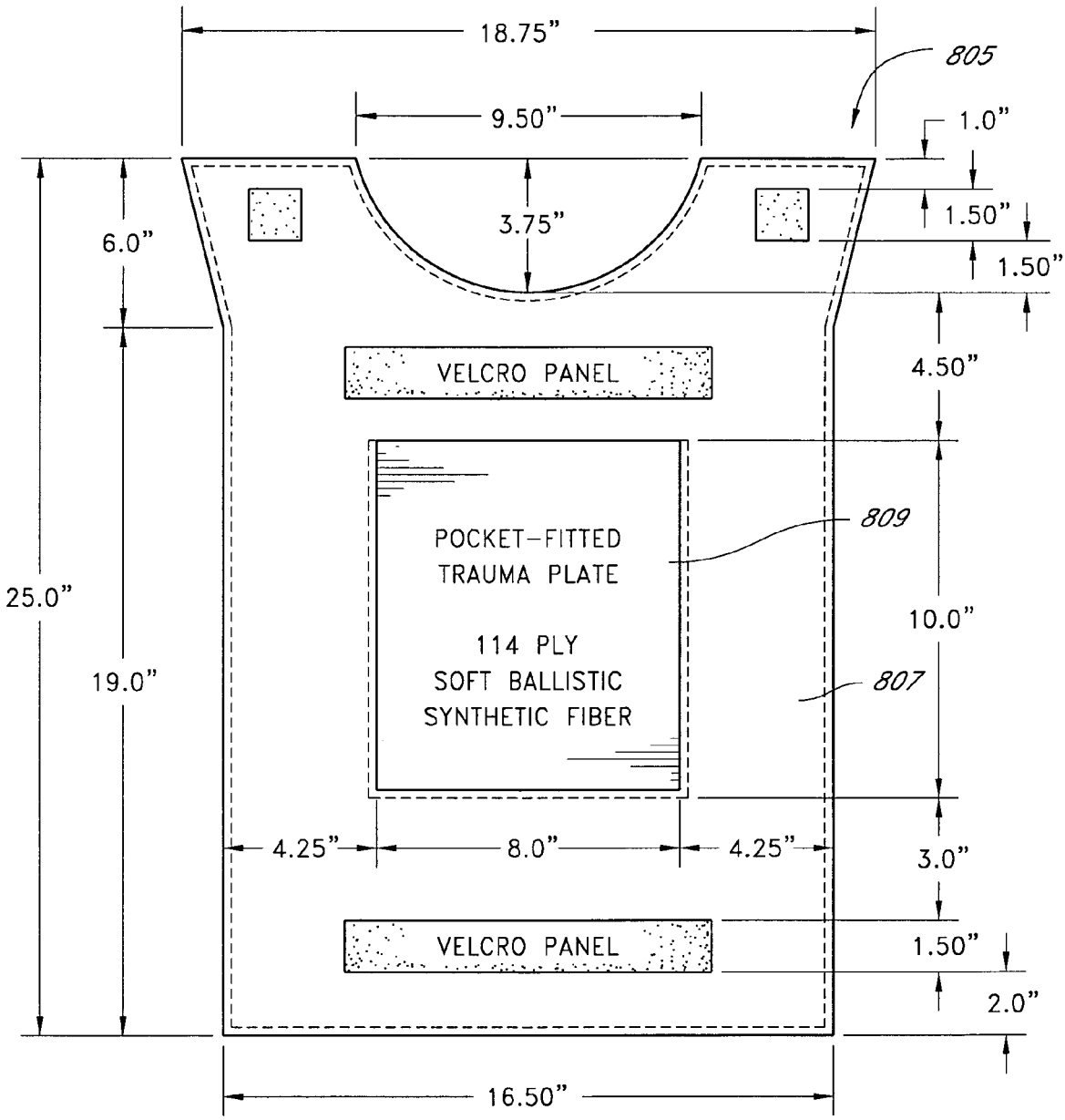
FIG. 8 is a front view of another embodiment of an armored vest.
Figure 9:
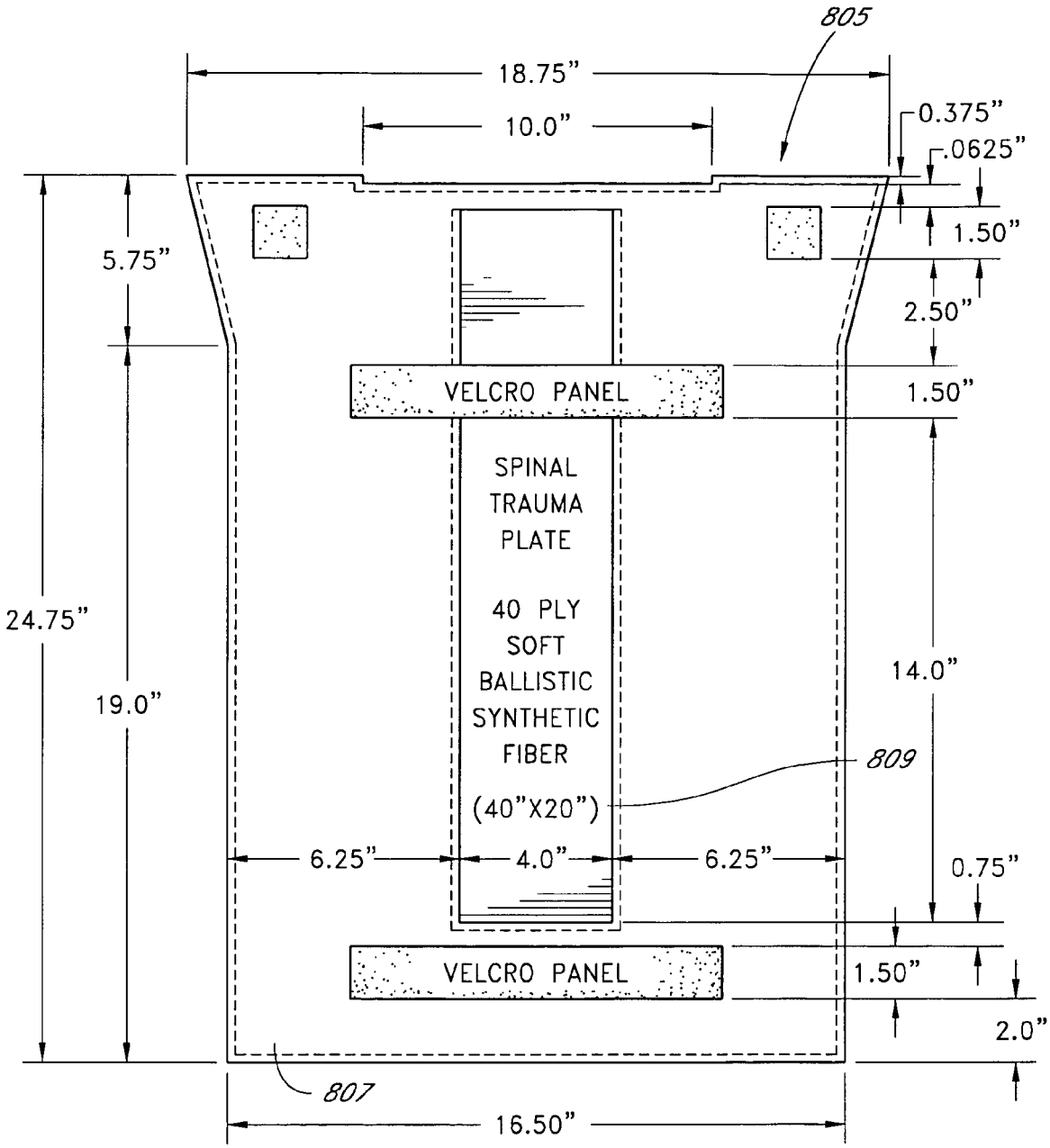
FIG. 9 is a rear view of the armored vest of FIG. 8.

FIGS. 8–9 depict front and rear views, respectively, of another embodiment of a vest 805 that may be constructed with any one or combination of the armor structures 100/200/300/400/500/600 disclosed herein. (The dimensions and specifications listed on FIGS. 8–9 are merely exemplary, and may be varied or omitted in other embodiments of the vest 805.) The vest 805 generally comprises a torso cover 807 and one or more trauma plates 809. The torso cover may be constructed from any of the armor structures disclosed herein, or any other suitable material, and the trauma plate(s) 809 may likewise be constructed from any of the herein-disclosed armor structures. The torso cover 807 extends behind or in front of the trauma plate(s) 809 so that enhanced protection is provided at the trauma plate(s). As seen in FIG. 9, the rear of the vest 805 may feature a spinal trauma plate to provide added protection at the wearer's spinal region. The spinal trauma plate may be formed from any of the armor structures disclosed herein, or may be formed from an outer section of 5 or more layers of ZYLON-530, a middle section of 6 or more layers of KEVLAR-726, and an inner section of 4 or more layers of KEVLAR-724 (i.e., KEVLAR similar to style no. 704 available from Hexcel Schwebel).

Figure 10:
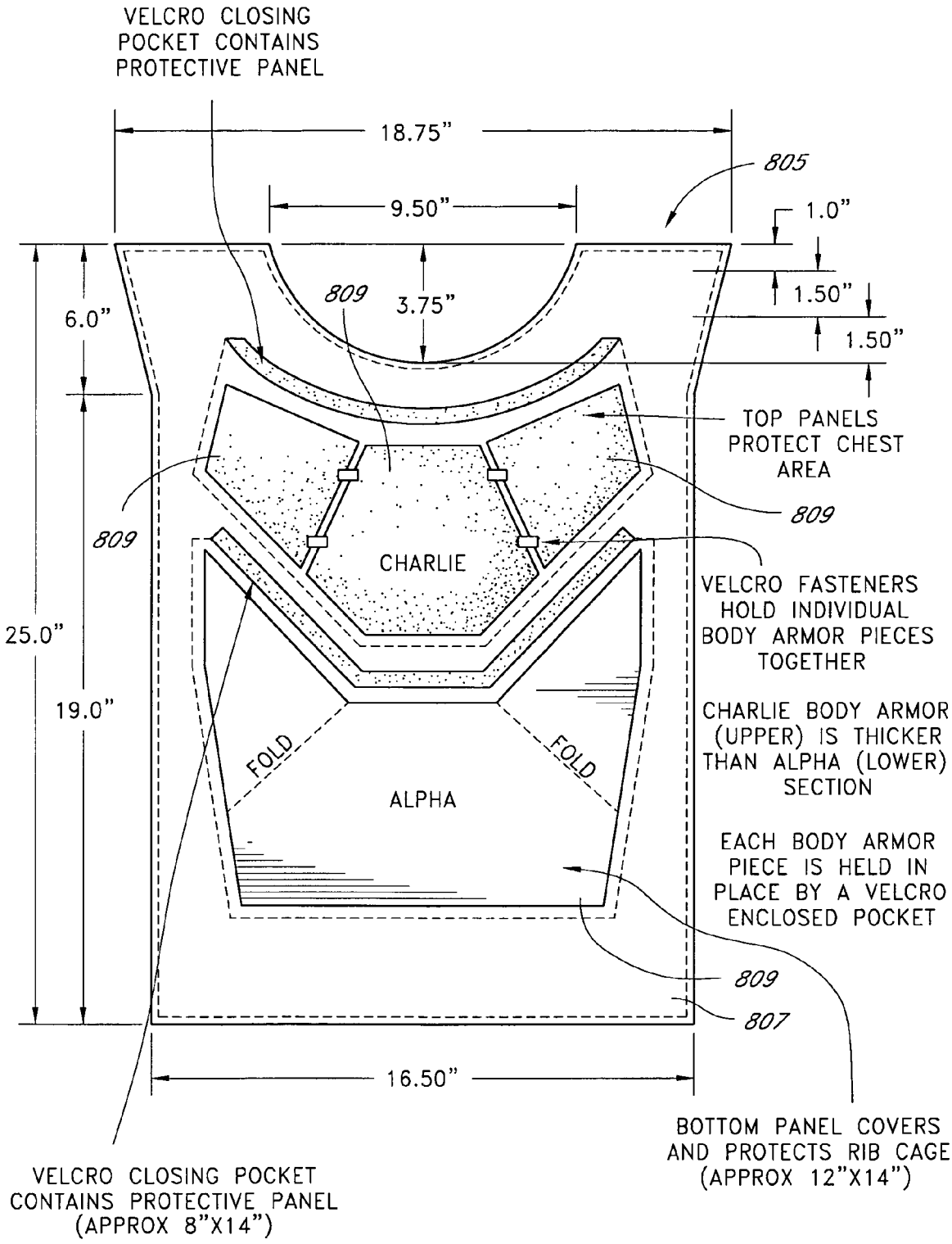
FIG. 10 is a front view of another embodiment of an armored vest.

FIG. 10 depicts a front view of another embodiment of the vest 805, which may be generally similar to the embodiment of the vest 805 shown in FIGS. 8–9, except as indicated in FIG. 10. (As with FIGS. 8–9, the dimensions and specifications listed on FIG. 10 are merely exemplary, and may be varied or omitted in other embodiments of the vest 805.)

Alternatively, any of the disclosed armor structures may be employed to construct soft body armor panels which may be sewn into, and/or enclosed in pockets formed in, a vest constructed from other suitable materials or fabrics.

Any of the disclosed armor structures 100, 200, 300, 400, 500, 600 may also be employed to form armor panels for use in vehicles, either on or against the vehicle "skin" or in critical locations like seats, cockpits, fuel tanks, hydraulic lines, ammunition stores, etc. Similarly, any of the disclosed armor structures 100, 200, 300, 400, 500, 600 may be employed to construct helmets or armor panels for buildings.

In constructing the armor structures and/or armored articles disclosed herein, each of the layers of soft armor material may be laser-cut into the desired perimeter shape. The layers may be cut individually or in groups of 2 or more. Laser cutting has proven advantageous in that it prevents fraying of woven soft armor materials as the laser heat tends to "heat-seal" the edges of the cut material. In some embodiments, an infrared laser or a carbon-dioxide laser may be employed.

Figure 11:
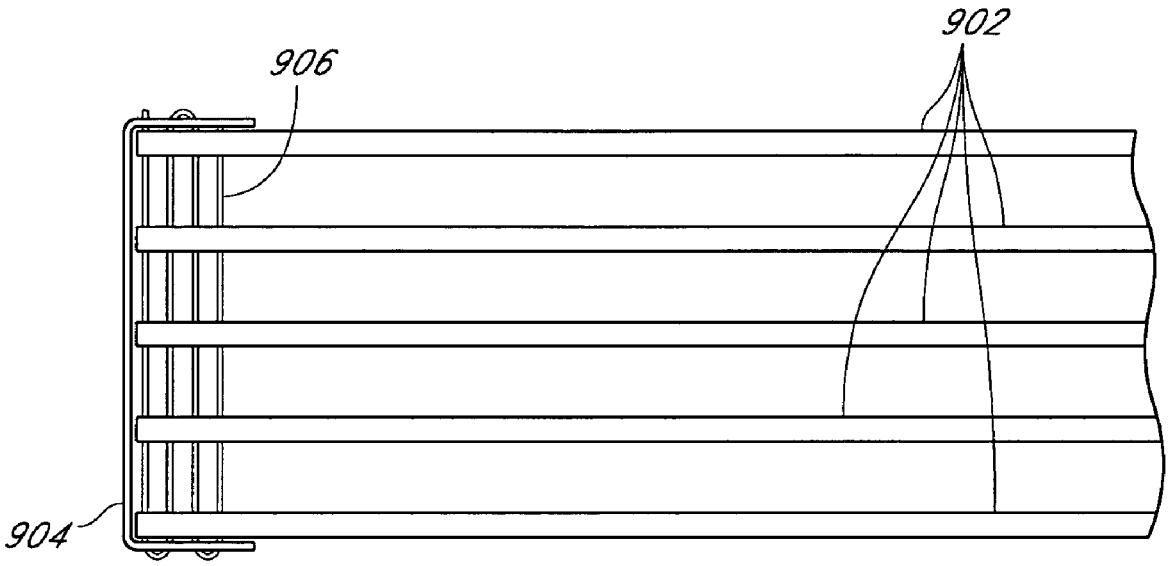
FIG. 11 is a schematic exploded sectional view of a technique usable for constructing various armor structures disclosed herein.

FIG. 11 depicts a construction technique that may be employed in joining together a number (e.g., 5, 10 or more) of layers 902 of soft armor material, to form a section or partial section of any of the armor structures 100/200/300/400/500/600 disclosed herein, or to form a complete armor structure. The technique involves applying an adhesive tape 904, such as a polymer tape, over some or all of the perimeter edges of the "sandwich" of layers 902. (In one embodiment, a polyethylene tape is employed.) After the tape 904 is applied, stitching 906 is passed through the tape 904 and layers 902, using any suitable stitching process. The technique illustrated in FIG. 11 may be employed in addition to the laser-cutting technique disclosed above.

Figure 12:
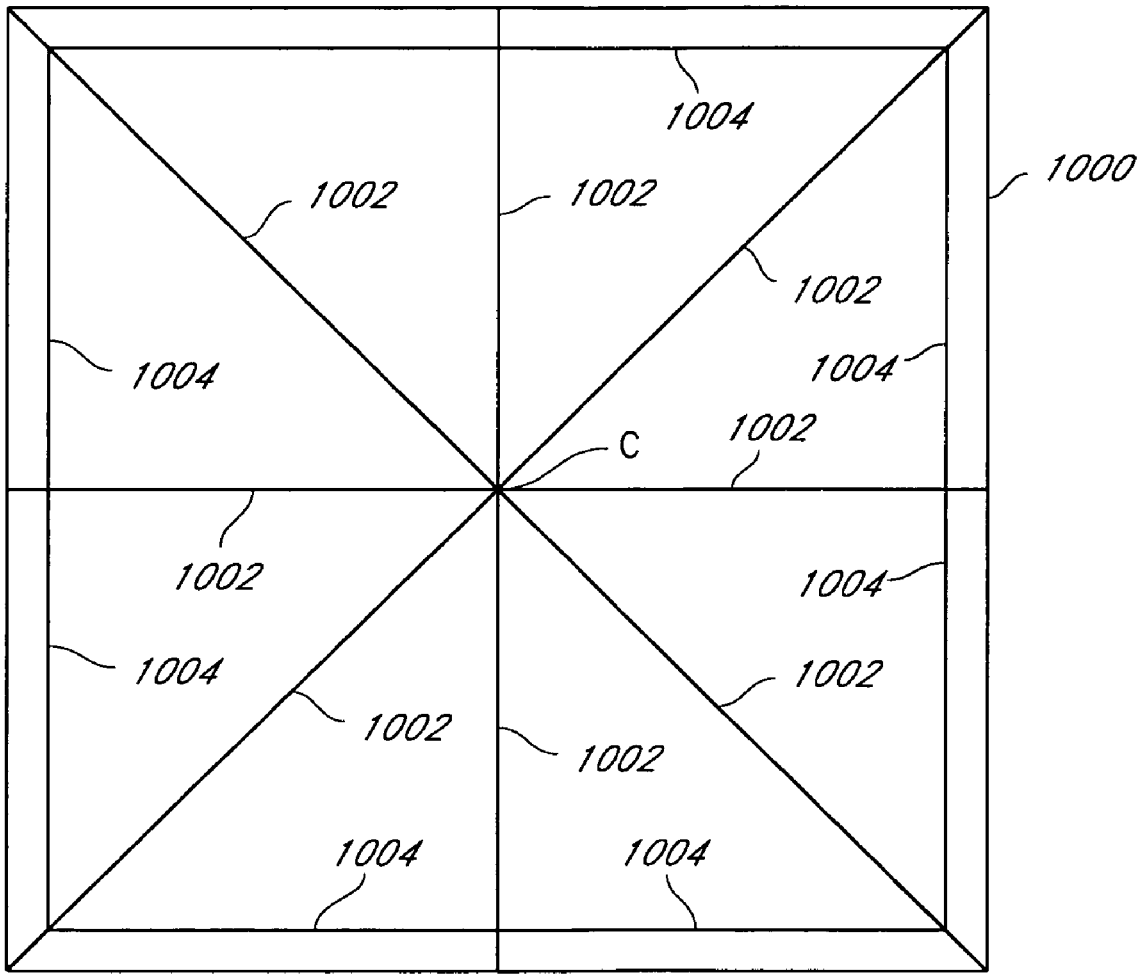
FIG. 12 is an elevation view of a stitch pattern usable for constructing various armor structures disclosed herein.

FIG. 12 depicts a stitch pattern that may be employed in stitching together a number of sections, layers, etc. to form any of the armor structures disclosed herein, or to form an armor panel or other armored article. The pattern includes a number (8 are depicted; alternatively, a smaller or larger number may be employed) of radial stitch lines 1002 that pass through the approximate center C of a panel/article 1000. In one embodiment, as shown in FIG. 12, the radial stitch lines 1002 are approximately equally angularly spaced about the center C. A number of optional perimeter stitch lines 1004 may also be employed near the edges of the panel/article 1000. (Although a square panel/article 1000 is depicted in FIG. 12, the depicted stitch pattern may be used in constructing panels/articles having any of a variety of perimeter shapes.)

Figure 13:
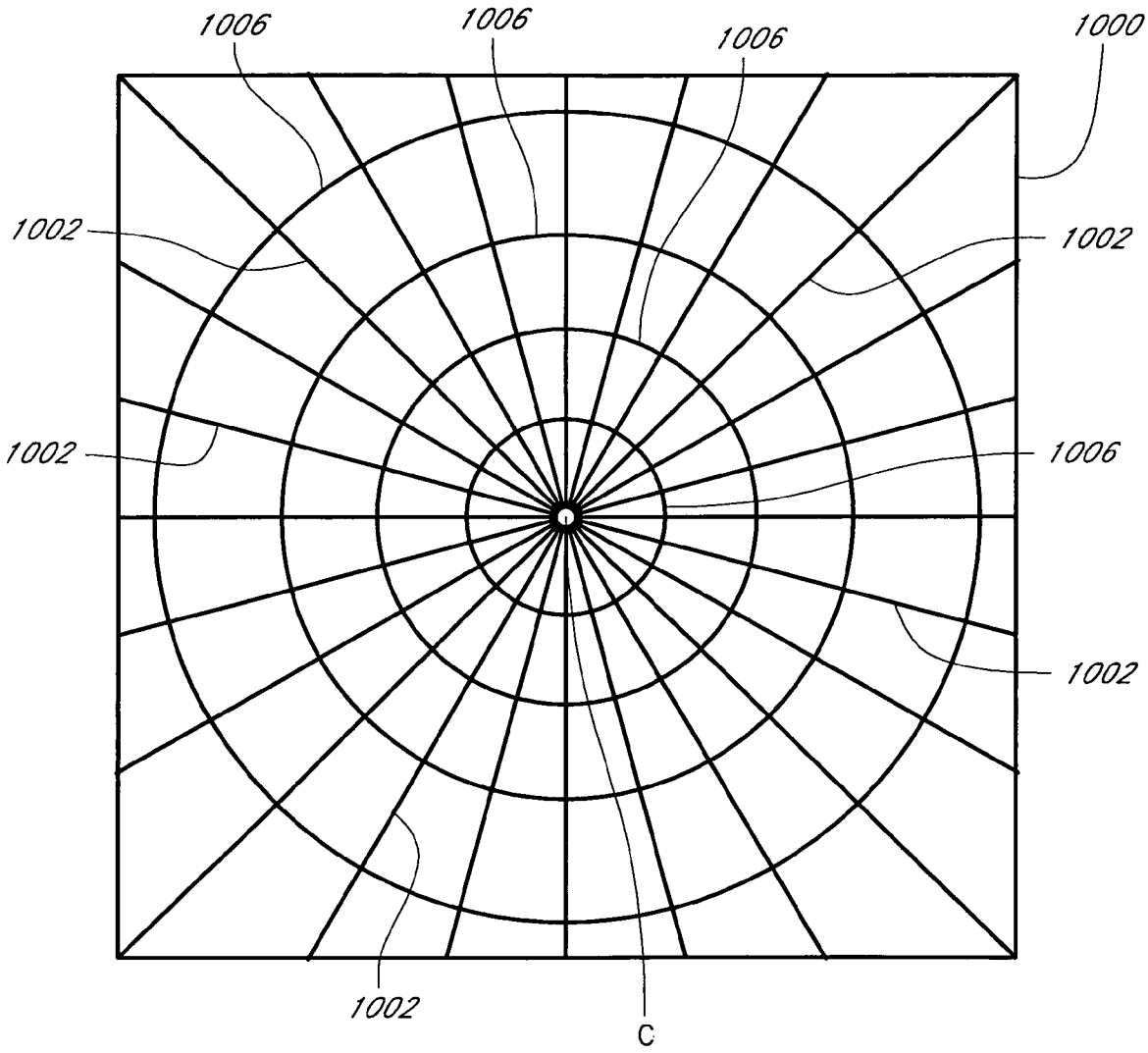
FIG. 13 is an elevation view of another stitch pattern usable for constructing various armor structures disclosed herein.

FIG. 13 depicts another stitch pattern that may be employed in stitching together a number of sections, layers, etc. to form any of the armor structures disclosed herein, or to form an armor panel or other armored article. Like the pattern shown in FIG. 12, the "spider-web" pattern of FIG. 13 includes a number of radial stitch lines 1002 that pass through the approximate center C of the panel/article 1000. A number of generally concentric circular stitch lines 1006 are also made to create the spider-web form shown in FIG. 13.

Either of the stitch patterns shown in FIG. 12 or 13, or any other suitable stitch pattern, may be employed with the laser cutting procedure disclosed above, and/or the construction technique shown in FIG. 11, in constructing any of the armor structures or armored articles disclosed herein. In addition, any of the armor structures, panels, sections etc. may be encased in an appropriate structural or waterproofing casing during or after fabrication.

Specifications for various materials discussed above are as set forth in the following tables.

ZYLON-530: SPECIFICATIONS

| | | |
|---|---|---|
| Yarn Type | Warp Yarn | Zylon AS, 500 denier |
| | Fill Yarn | Zylon AS, 500 denier |
| Fabric Weight | 4.00 | oz/yd$^2$ |
| | 136 | g/m$^2$ |
| Weave Style | Plain | |
| Nominal Construction | Warp Count | 30 |
| (yarns/inch) | Fill Count | 30 |
| Fabric Thickness | 8.0 | mils |
| | 0.20 | mm |
| Breaking Strength | 1080 | lbf/in |
| | 1020 | lbf/in |

KEVLAR-704: SPECIFICATIONS

| | | |
|---|---|---|
| Yarn Type | Warp Yarn | Kevlar 129, 840 denier |
| | Fill Yarn | Kevlar 129, 840 denier |
| Fabric Weight | 7.0 | oz/yd$^2$ |
| | 237 | g/m$^2$ |
| Weave Style | Plain | |
| Nominal Construction | Warp Count | 31 |
| (yarns/inch) | Fill Count | 31 |
| Fabric Thickness | 12.0 | mils |
| | 0.3 | mm |
| Breaking Strength | 900 | lbf/in |
| | 950 | lbf/in |

KEVLAR-724: SPECIFICATIONS

| | | |
|---|---|---|
| Yarn Type | Warp Yarn | Kevlar 129, 1000 denier |
| | Fill Yarn | Kevlar 129, 1000 denier |
| Fabric Weight | 6.5 | oz/yd$^2$ |
| | 220 | g/m$^2$ |
| Weave Style | Plain | |

-continued

| KEVLAR-724: SPECIFICATIONS | | |
|---|---|---|
| Nominal Construction | Warp Count | 24 |
| (yarns/inch) | Fill Count | 24 |
| Fabric Thickness | 11.0 | mils |
| | 0.28 | mm |
| Breaking Strength | 763 | lbf/in |
| | 776 | lbf/in |

| KEVLAR-726: SPECIFICATIONS | | |
|---|---|---|
| Yarn Type | Warp Yarn | Kevlar 129, 840 denier |
| | Fill Yarn | Kevlar 129, 840 denier |
| Fabric Weight | 6.0 | oz/yd$^2$ |
| | 203 | g/m$^2$ |
| Weave Style | Plain | |
| Nominal Construction | Warp Count | 26 |
| (yarns/inch) | Fill Count | 26 |
| Fabric Thickness | 10.0 | mils |
| | 0.25 | mm |
| Breaking Strength | 760 | lbf/in |
| | 770 | lbf/in |

| SPECTRASHIELD PLUS-902: SPECIFICATIONS | | |
|---|---|---|
| Yarn Type | Warp Yarn | Spectra 900, 1200 denier |
| | Fill Yarn | Spectra 900, 1200 denier |
| Fabric Weight | 5.5 | oz/yd$^2$ |
| | 187 | g/m$^2$ |
| Weave Style | Plain | |
| Nominal Construction | Warp Count | 17 |
| (yarns/inch) | Fill Count | 17 |
| Fabric Thickness | 18.0 | mils |
| | 0.46 | mm |
| Breaking Strength | 900 | lbf/in |
| | 850 | lbf/in |

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. Soft armor comprising:

an armor structure having a threat side and an inner side inward of said threat side;

said armor structure being formed from soft armor material;

said armor structure being substantially imperforable by armor-piercing handgun fire;

wherein said armor structure comprises:

a first section of at least 10 layers of PBO fabric, overlying a second section of at least 6 layers of para-aramid fabric, overlying a third section of at least 8 layers of para-aramid fabric, overlying a fourth section of at least 22 layers of PBO fabric, overlying a fifth section of at least 3 layers of para-aramid fabric.

2. An armor panel formed from the soft armor of claim 1.

3. A garment comprising at least one of the armor panel of claim 2.

4. A vest comprising at least one of the armor panel of claim 2.

5. A helmet comprising the soft armor of claim 1.

6. Soft armor comprising:

an armor structure having a threat side and an inner side inward of said threat side;

said armor structure being formed from soft armor material;

said armor structure being sufficiently strong to defeat armor-piercing handgun fire;

wherein said armor structure comprises:

a first section of at least 10 layers of PBO fabric, overlying a second section of at least 6 layers of para-aramid fabric, overlying a third section of at least 8 layers of para-aramid fabric, overlying a fourth section of at least 22 layers of PBO fabric, overlying a fifth section of at least 3 layers of para-aramid fabric.

7. An armor panel formed from the soft armor of claim 6.

8. A garment comprising at least one of the armor panel of claim 7.

9. A vest comprising at least one of the armor panel of claim 7.

10. A helmet comprising the soft armor of claim 6.

* * * * *